US006354911B1

(12) United States Patent
Lindquist et al.

(10) Patent No.: US 6,354,911 B1
(45) Date of Patent: Mar. 12, 2002

(54) METHOD AND APPARATUS FOR END-ROUNDING BRISTLES

(75) Inventors: Donald Lindquist, Rockford, IL (US); Kenan Bible, Del Rio, TN (US); James Collins, Greenville, TN (US); Lloyd Etter, Morristown, TN (US)

(73) Assignee: Moll Industries, Inc., Morristown, TN (US)

( * ) Notice: Subject to any disclaimer, the term of this patent is extended or adjusted under 35 U.S.C. 154(b) by 0 days.

(21) Appl. No.: 09/579,745

(22) Filed: May 26, 2000

(51) Int. Cl.[7] ..... B24B 1/00

(52) U.S. Cl. ..... 451/28; 451/162; 451/163; 451/443; 451/916; 300/17; 300/18; 300/19; 300/21

(58) Field of Search ..... 451/28, 162, 163, 451/443, 916; 300/17, 18, 19, 21

(56) References Cited

U.S. PATENT DOCUMENTS 2,354,898 A * 8/1944 Wiksten ..... 15/3
3,836,199 A * 9/1974 Blankschein ..... 300/21
3,877,753 A * 4/1975 Ripstein ..... 300/21

* cited by examiner

*Primary Examiner*—Joseph J. Hail, III
*Assistant Examiner*—Shantese McDonald
(74) *Attorney, Agent, or Firm*—Choate, Hall & Stewart

(57) ABSTRACT

An apparatus for end-rounding bristles in a brush having different heights. The apparatus includes pins disposed in pre-determined locations such that they will contact selected bristles in a brush abutting the apparatus when the pins travel a two-dimensional path. The height of the pins is adjusted according to the heights of the selected bristles.

39 Claims, 3 Drawing Sheets

ROTATION
OR
ROTATION
A
B
12a
12b
12c
43

METHOD AND APPARATUS FOR END-ROUNDING BRISTLES

FIELD OF THE INVENTION

This invention relates to an apparatus for end-rounding bristles for brushes and more particularly to an apparatus which can end-round bristles having a variety of heights.

BACKGROUND OF THE INVENTION

Most brushware, especially toothbrushes, is produced via a two-part technique. The handles are produced by injection molding, following which the bristles are inserted into the handle. The most common technique for inserting the bristles into the brushes is stapling. The bristles are folded around a metal staple which is pushed into a pre-molded hole in the brush. The staple cuts into the plastic at the periphery of the hole, and the plastic retains both it and the bristles.

In an alternative technique, the bristles are fused with the handle. Either the bristles or the brushhead, or both, are heated, and the bristles are inserted into holes in the handle where they are retained by the cooling plastic. Exemplary techniques for brush production by fusion include those described in U.S. Pat. No. 4,988,146, which describes a fusion process wherein the ends of bristle bundles are thermally fused, shortening and locally thickening the bundles to form a fuse-ball, or fuse, which is inserted into a hole in a brush handle. However, it is not necessary to use a handle with prefabricated holes; the holes can be formed immediately prior to the insertion of the bristles. In a process called "hedgehogging," the handle is heated, and a set of short spikes mounted on a heated plate is pushed into the head of the handle to form holes to receive the bristles. U.S. Pat. No. 4,637,660 describes an exemplary hedgehogging process wherein, as the holes are formed in the handle, the displaced material is organized into a small bead surrounding the newly-formed hole. As in the '146 patent, the bristle ends are fused before they are inserted into the hedgehogged holes. Material from the small bead flows around the fuse after it is fitted into the hole, enclosing the bristles in the brush head.

In an alternative technique, called "in-mold bristling," the handle is molded around the bristles. As in the fusion processes described above, the ends of the bristles are fused. The fused ends of the bristles are held in a mold cavity into which the material for the handle is injected. The cooled material becomes the head of the brush and also retains the bristles. An exemplary in-mold technique is disclosed in U.S. Pat. No. 5,143,424.

In each of these techniques, the use-ends of the bristles must be polished, or end-rounded, to remove rough edges which result from trimming. The sharp edges can cut into the gums of a consumer, causing pain and bleeding. The bristles are fed into the brushmaking apparatus from a pre-cut supply or trimmed from an endless supply, or creel, as each brush is produced. The bristles may be inserted directly into the brush, as for a staple-set process, or into a magazine in which the bristles are further processed before being united with the handle.

U.S. Pat. Nos. 5,431,484 and 5,518,300 disclose methods for end-rounding bristles before they are inserted into a brush. The '484 patent teaches that the free end of an endless supply of bristles is guided to a grinding device and supported at a predetermined distance from the bristle ends. The pre-determined distance is selected to control the flexure of the bristles as they are polished by a rotating plate on the grinding device. After the bristle ends are end-rounded, they are cut to the proper length for insertion into a brush. The '300 patent teaches a method of producing a staple-set brush in which the bristles are polished after being removed from a pre-cut supply but before insertion into the brush.

U.S. Pat. No. 4,979,782 discloses a brush production method in which the bristles are end-rounded before insertion into the handle. The bristles are clamped so that their ends are in a flat plane. The bristles are then end-rounded, following which they may be profiled to take on a variety of lengths. After profiling, the bristles are inserted into a brush.

U.S. Pat. No. 5,176,427 discloses a method of varying the flexure of bristles for end-rounding. A movable clamp is adjusted to retain the bristles at a fixed distance from their use ends. The distance can be varied but is the same for all bristles, as they are polished while their use ends are in a plane.

U.S. Pat. Nos. 5,649,851 and 5,653,628 both describe end-rounding bristles with a rotating cylinder. In the '851 patent, a brush, for example, a toothbrush, is held against an abrasive strip on the outside of a rotating cylinder. As the cylinder rotates, the abrasive strip polishes the ends of the bristles. The '628 patent discloses an apparatus and method for polishing the bristles of a cylindrical brush. In contrast to the '851 patent, the abrasive is disposed on the inside of the cylinder rather than the outside. The cylindrical brush is passed into the cylinder and either the cylinder or the brush rotated to pass the bristles over the abrasive, end-rounding the bristles.

Modem brushes generally contain bristles having a variety of lengths. Both the individual bristles in a bundle or tuft and the tufts themselves may vary widely in length. Prior art end-rounding methods employ flat, diamond-coated plates which vibrate in an eccentric, two-dimensional path as the bristles are held against them. This method works well for brushes having bristles of one length but is less effective for bristles of varying length. As the difference in bristle height increases, the force on the longer bristles increases, and the finish quality of the shorter bristles decreases. Bristle bundles with significantly different heights are typically not polished in a single step. Instead, the longer bristles are pushed aside by a sleeve while the shorter bristles are polished, following which they are released and end-rounded. However, if the longer and shorter bristle bundles are interspersed, the sleeve cannot mask the longer bristles without also masking the shorter ones.

SUMMARY OF THE INVENTION

In one aspect, the invention is an apparatus for end-rounding bristles for a brush. The apparatus includes a plurality of pins disposed on a base and an abrasive coating disposed on at least an end of the pins. When a plurality of bristles are disposed adjacent to the pins, two-dimensional motion of the base will cause the pins to polish ends of the bristles. The pins may be configured to polish bristles having a plurality of lengths simultaneously, and the apparatus may further comprise retaining means to hold the plurality of bristles adjacent to the pins. The pins may be adapted and constructed to have a length such that an overlap between an end of the pin and an end of a bristle contacted by the pin is between 0.005 and 0.050 inches when the plurality of bristles is adjacent to the pins. The pins may be arranged on the base such that, when the plate is in motion, each pin polishes ends of a pre-determined bundle of bristles. The bristle bundles may vary in height such that they could not all be polished simultaneously with planar polishing means, and the ends of the bristles need not be oriented perpendicular to a plane of motion of the base. The pins may be constructed and arranged to only polish a portion of the plurality of bristles. An end of each of the pins may comprise a partially rounded tip having a radius of curvature between 0.075 and 0.08 inches. The tip may be truncated in a flat plane having a truncation depth between 2.5 and 65% of the radius of curvature. The diameter of each pin may be at least ⅛ inches, at least 5/32 inches, or at least as long as a lateral dimension of a pattern defined by the plurality of bristles. The abrasive coating may comprise a diamond coating having a grit size between 200 and 600 grit.

In another aspect, the invention is a method of end-rounding bristles in a plurality of bundles. The method comprises selecting a two-dimensional motion path for a plate, identifying a point on the plate that travels a path intercepting a position of a first bundle of bristles that is disposed in a polishing position with respect to the plate, and selecting an abrasive pin to place at the identified point. The pin has a height such that, when the first bristle bundle is disposed in the polishing position, the pin will polish ends of bristles in the first bristle bundle. The steps of identifying and selecting a pin may be repeated for a subsequent point corresponding to a second bundle of bristles, and the average height of the bristles in the first and second bundles of bristles need not be the same. The pins may be constructed and arranged to polish a portion of a plurality of bristle bundles that vary in height such that all the bristle bundles could not be polished simultaneously with planar polishing means, and the ends of the bristles need not be oriented perpendicular to a plane of motion of the plate.

In another aspect, the invention is a method of end-rounding a plurality of bristles. The method comprises disposing ends of the bristles in a path of a translatable abrasive pin and moving the pin such that it polishes ends of the bristles. The bristles may be disposed in at least one bundle of a plurality of bundles having a variety of heights such that all the bristle bundles could not be polished simultaneously with planar polishing means. The path of the pin may comprise a four-lobed pattern that defines two perpendicular axes. Alternatively, the path of the pin may comprise two superimposed four-lobed patterns, wherein each set of four lobes defines two perpendicular axes. The method may be adapted for use with a plurality of pins or a plurality of bristle bundles, or both.

BRIEF DESCRIPTION OF THE DRAWING

The invention is described with reference to the several figures of the drawing, in which.

DETAILED DESCRIPTION

Figure 1:
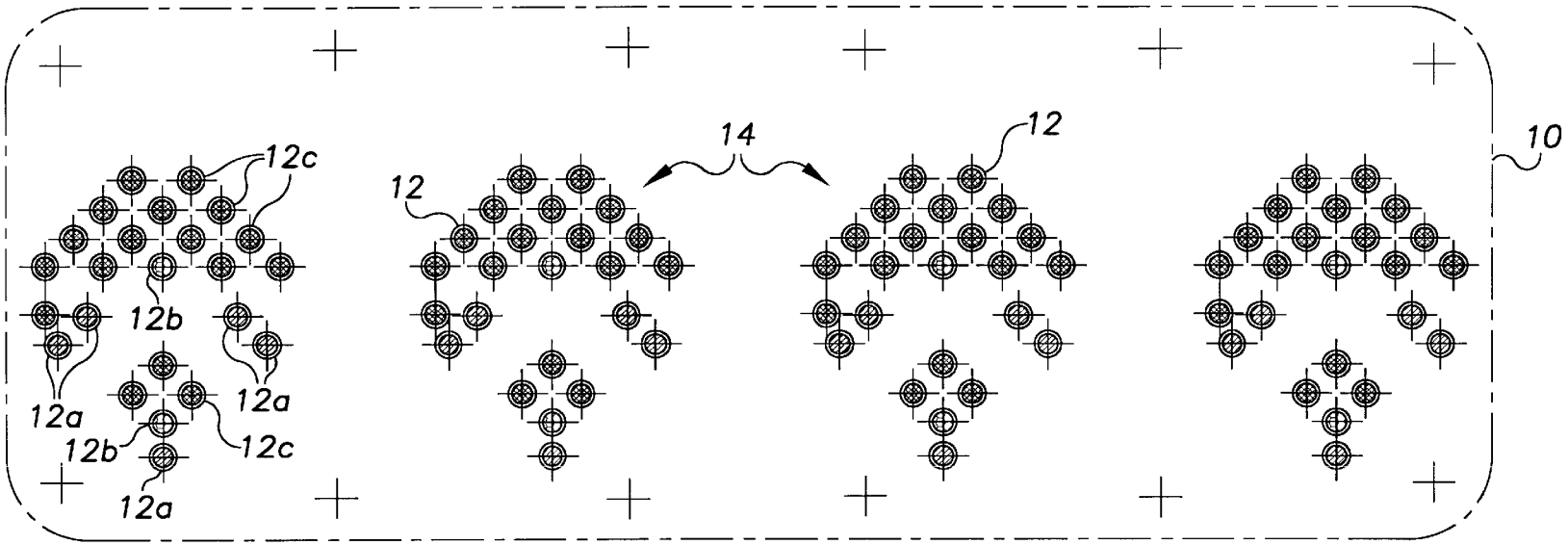
FIG. 1 is a top view of a plate with abrasive pins according to an embodiment of the invention.
Figure 2:
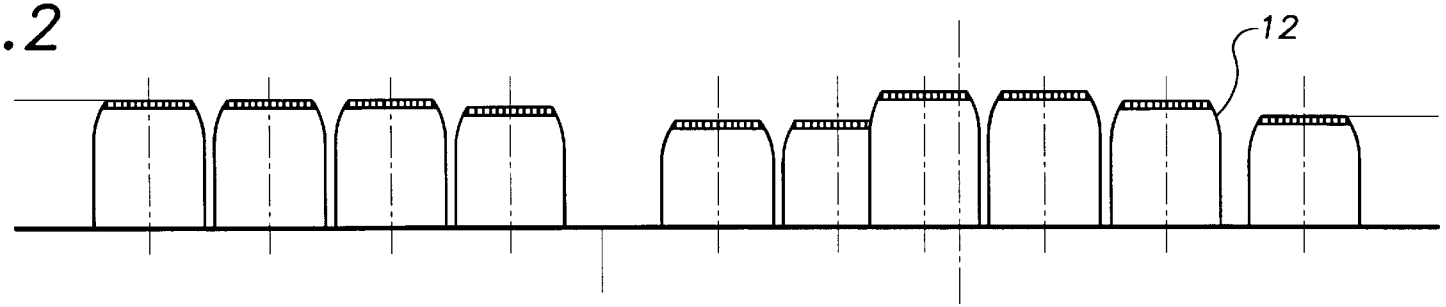
FIG. 2 is a side view of a row of abrasive pins.
Figure 3:
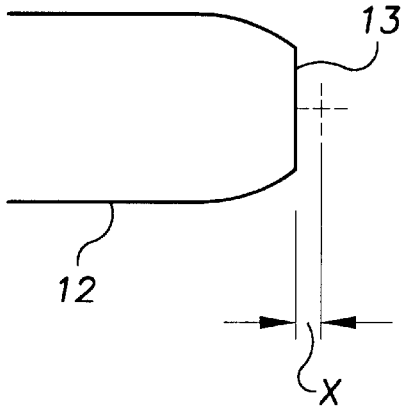
FIG. 3 is a side view of a pin.

In one embodiment, the invention comprises an end-rounding apparatus having a plurality of pins which protrude from a oscillating plate. The apparatus may be used with any of the brushmaking methods disclosed above. An exemplary plate 10 having pins 12 is depicted in FIG. 1. The pins are arranged in groups 14 that need not exhibit the same symmetry as the bristles in the finished brush. The plate 10 shown is configured to process bristles for four brushes simultaneously. However, the plate may be constructed to support any number of groups 14. Pins having a range of heights, as shown in FIG. 2, are preferred to polish bristles having a range of heights. In a preferred embodiment, the pins are truncated cylinders terminating in a partially rounded section having a radius of curvature between 0.075 and 0.08 inches (FIG. 3). In but one example, radius of curvature may be 0.078 inches. The entire end of the pin is not rounded. Rather, an end 13 of the pin is flat, truncating the hemisphere defined by the curvature. The truncation depth x is preferably about 2.5–65% of the radius of curvature. For the preferred radius of 0.078 inches, the truncation depth may be 0.002–0.050 inches. For a pin diameter of 5/32 inches, this radius of curvature and truncation depth results in a tip diameter of 0.125 inches. The pin diameter, radius of curvature, and truncation depth may be adjusted for different bristle materials and bundle sizes. The pin diameter may range from ⅛ inches to an area larger than the entire group 14 or even several groups 14. In a preferred embodiment, only the flat end 13 of the pin is coated with an abrasive. A wide variety of abrasives are well-known to those skilled in the art; in a preferred embodiment, a diamond abrasive having a grit size of 200–600 grit is employed. The grit may be optimized for different bristle materials and bristle filament shapes.

Figure 4:
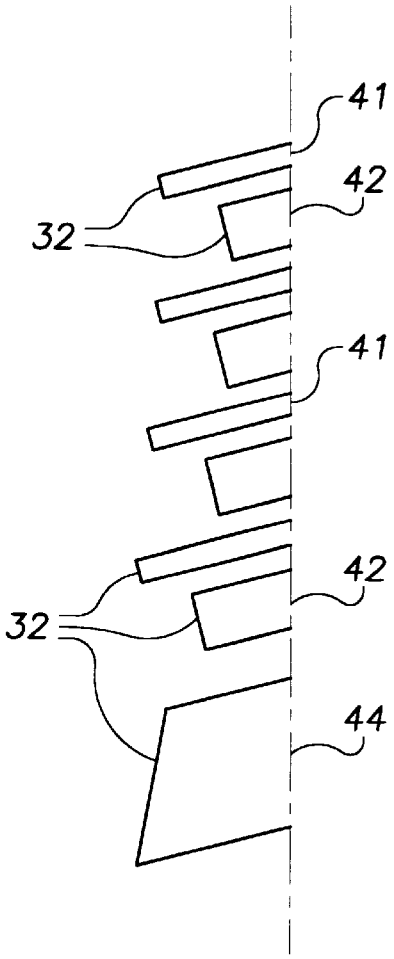
FIG. 4 is a cross-sectional view of a row of bristles in the brushhead.

FIG. 4 depicts a cross-section of bristle bundles 32 in one row of an exemplary toothbrush, showing the variation in height among them. Traditional end-rounding methods are typically not used to polish bristles having a large height difference simultaneously. Rather, the longer bristles are shielded while the shorter bristles are end-rounded. The maximum height difference of simultaneously end-rounded bristles is determined by the types of bristles in the brush. In contrast, the apparatus of the present invention is able to polish bristles having a wide variety of heights simultaneously. In addition, even if it is desirable to polish the longer bristle bundles in a separate step, the invention enables shorter bristle bundles interspersed among the longer bristle bundles to be polished without the need to shield the longer bristle bundles. Indeed, if the taller bristle bundles 41 and 44 and shorter bristle bundles 42 are interleaved, as in the example depicted in FIG. 4, it may be impossible to shield the taller bristle bundles without also preventing the shorter bristle bundles from being polished.

In addition, the use of pins instead of a flat plate to end-round the bristles enables the practitioner to polish selected bristles with selected polishers rather than end-rounding rounding the various bristles with the same abrasive. As a result, appropriate abrasives can be chosen for bristles made of different materials. In addition, the concentration of the abrasive on the end of the pin can also be adjusted for different bristle materials or bundle shapes, as can the shape of the pin itself.

As shown in FIG. 2, the pins 12 have a variety of heights determined by the length of the specific bristle bundles each pin will polish. The path each pin needs to travel to polish the appropriate bristle bundles 32 is calculated and the pins placed at the proper point on plate 10 to travel the calculated path as plate 10 moves in a pre-determined two-dimensional pattern. For brushes having other arrangements of bristles, the positions of the pins and the movement path of the plate may need to be adjusted.

Figure 6:
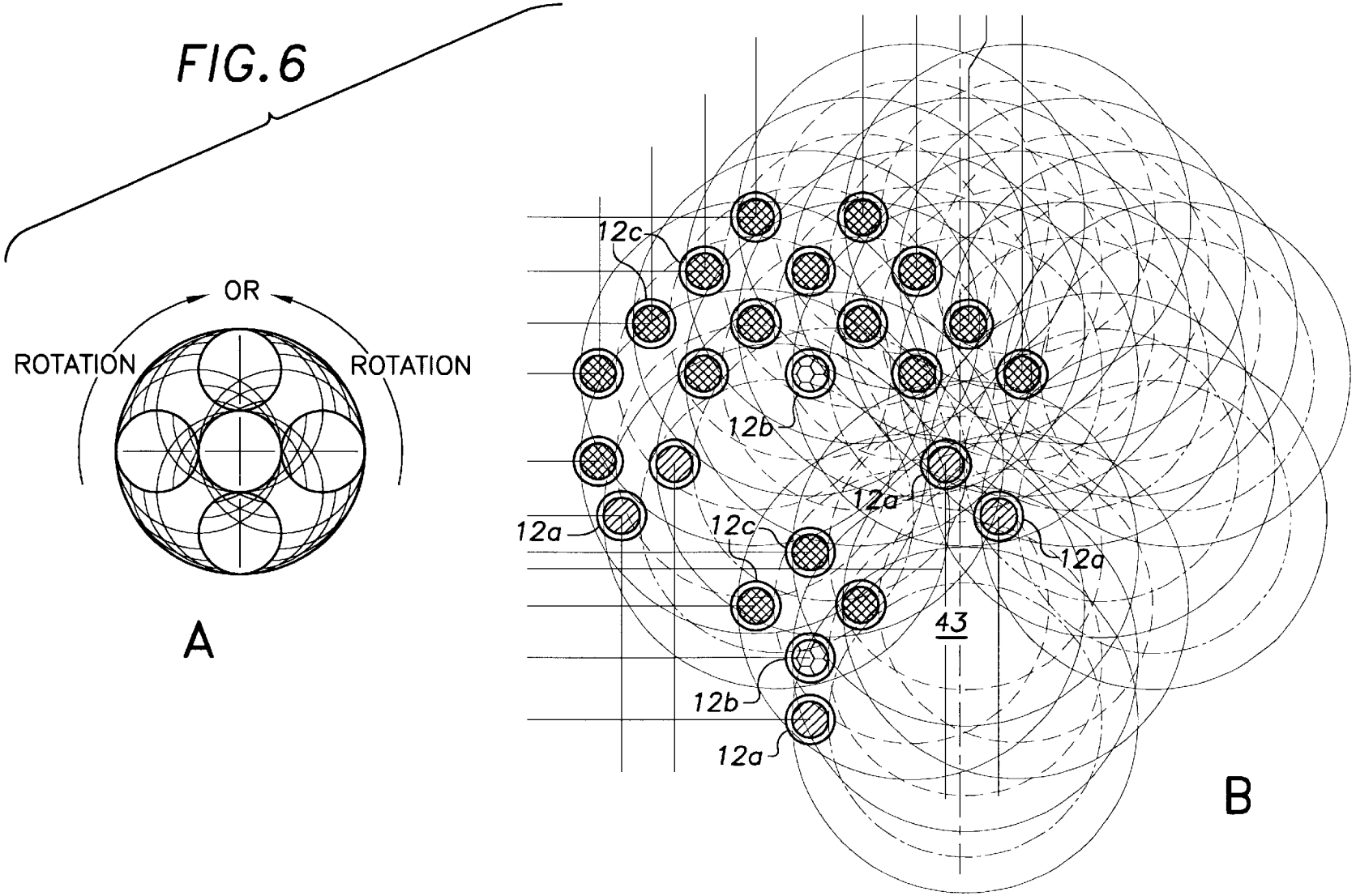
FIG. 6 is of the paths traversed by the pins during end-rounding.

FIG. 6 depicts the paths traversed by pins 12 for an exemplary motion path of plate 10. The two-dimensional path traveled by the plate 10 has two components. The first component rotates the pins in an eccentric path which defines a small-diameter circular pattern for each pin (FIG. 6A). The second component rotates the groups 41 in a larger circular pattern (FIG. 6B). Both of these patterns are symmetric about their centers. That is, the circular pattern is not centered on an origin but rather includes four separate, overlapping circular paths arranged in a cloverleaf pattern centered on the origin. The origin of travel need not correspond to a symmetry element of the brush; indeed, it need not even be located on the brush. Once the path is known, the location a pin must be placed at in order to contact the appropriate bristle bundles 32 is easily determined by overlaying a diagram of the brush on a diagram of the motion path of the plate. The two components of the path traveled by plate 10 may be adjusted depending on the distances between bristle bundles 32.

Figure 5:
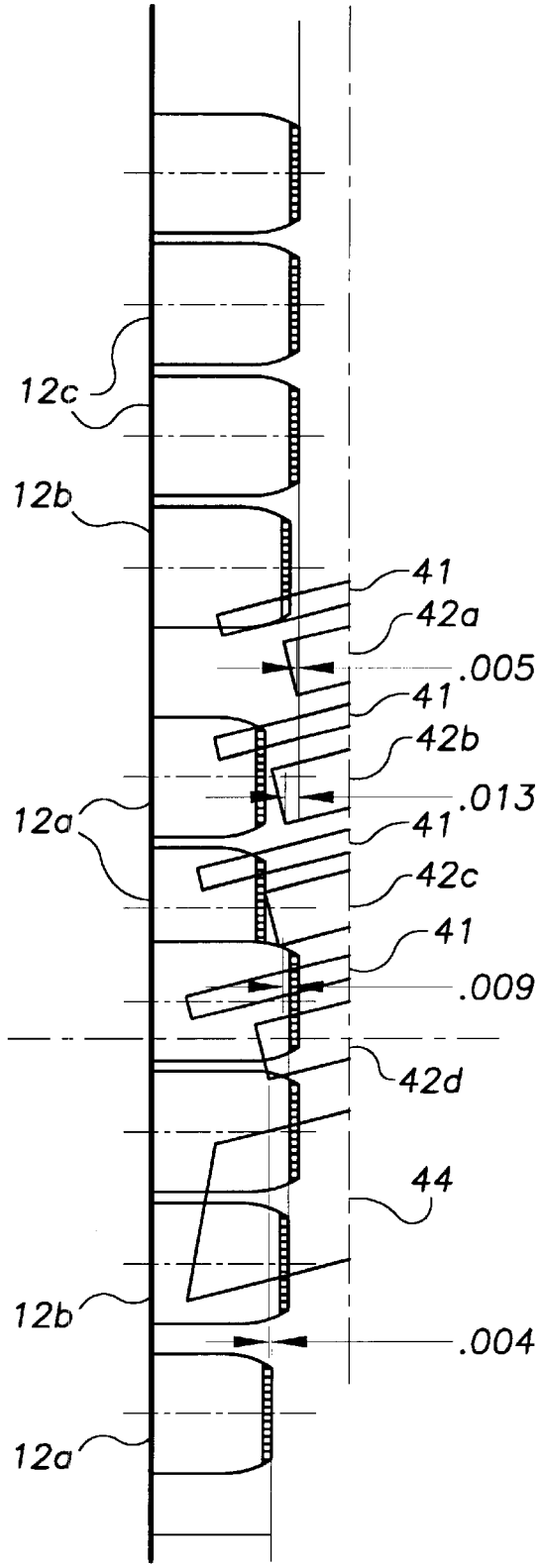
FIG. 5 is a side view of the row of bristles abutted to the pins.

If the pin 12 penetrates too deeply into bristle bundle 32, it may damage the individual bristles; excessive penetration can cause the bristles to bend, pushing their ends away from the abrasive disposed on the pin. As a result, the bristle strand is abraded without actually achieving end-rounding. On the other hand, because the end of the pin is not necessarily parallel to the end of the bristle bundle, the pin must penetrate some distance into the bundle in order to polish all of the bristles in the bundle. FIG. 5 combines FIGS. 2 and 4 and shows the bristle bundles 32 abutting pins 12 for polishing. Three different heights of pins 12*a*, 12*b*, and 12*c* are shown in FIG. 5 along with cross-sections of the bristle bundles as they are held by a retainer 50 for end-rounding. Exemplary retainers include a magazine for transporting bristles through a manufacturing apparatus or a toothbrush mounted in such an apparatus. The bristle bundles exhibit a range of heights of about 0.4 in. It will be easily recognized that the height difference and arrangement is merely exemplary and that other arrangements of bristles may also be used with the invention. If the four lengths of bristle bundles, from shortest to longest, are identified as 42*a, b, c*, and *d*, then it is easily seen that pin 12*a* is too short to polish bristles 42*a* and 42*b*. However, pin 12*a* penetrates at least 0.004 in. of bristle bundle 42*d* and just grazes the end of bristle bundle 42*c*. Likewise, pin 12*b* penetrates 0.009 in. of bristle bundle 12*c*, and pin 12*c* penetrates 0.013 in. of bristle bundle 12*b* and 0.005 in. of bristle bundle 12*a*. In addition, because the bristle bundles 32 are oriented at an angle with respect to pins 12, the pins interact differently with the individual bristles in each bundle. For example, if pin 12*a* penetrates 0.004 inches beyond knee 43*a* of bristle bundle 42*d*, then it also penetrates the added length of the longer bristles in bundle 42*d*. That is, if the end 43*b* of bristle bundle 42*d* is 0.009 inches taller than knee 43*a*, as measured parallel to pins 12, then pin 12*a* will penetrate 0.013 inches at the longer portion of bristle bundle 42*d*. Even though a given bristle bundle 32 may be contacted by several pins, each contacting pin will not polish the bristle bundle in the same manner because of the difference in penetration. The above embodiment is a non-limiting example; the optimal penetration varies with the free length of the bristles and the grit of the abrasive(the distance between the free end of the bristles and the retaining means) and should be between 0.005 and 0.050 in. For example, for a fusion process where the bristles are retained in a magazine during end-rounding, the penetration should be 0.0150–030 in. Less penetration is required if the bristles are retained closer to their ends. Of course, if the end of the bristle bundle is not parallel to the end of pin 12, then the penetration with vary among the bristles in the bundles.

The positions of pins 12*a, b*, and *c* are configured such that, when the plate is in motion, the pins only contact those bristle bundles they are meant to polish. For example, FIG. 6 demonstrates that the paths traveled by the various pins 12 all avoid region 43, which corresponds to the position of toe tuft 44. Indeed, it is preferable to end-round longer tufts 41 and toe tuft 44 in a separate processing step, perhaps using a traditional end-rounding apparatus, because of the great difference in height between longer tufts 41 and toe tuft 44 and bristle bundles 42.

If the bristles are staple set, then they are cut to a desired length after insertion into the handle. In contrast, if bristles are inserted into a magazine, they may be profiled before end-rounding and/or insertion into the brush. While it would certainly be possible to end-round the bristles before profiling, while they still lie in a single plane, the bristles may still not be polished uniformly if they are in bundles of different diameters or if they are made of different materials, as described above. Bristles in smaller bundles will be able to flex more during polishing and will be abraded more than bristles in larger bundles, which tend to be stiffer.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus for end-rounding bristles for a brush, comprising:

a plurality of pins disposed on a base; and an abrasive coating disposed on at least an end of the pins, wherein, when a plurality of bristles are disposed adjacent to the pins, two-dimensional motion of the base will cause the pins to polish ends of the bristles.

2. The apparatus of claim 1, wherein the pins are configured to polish bristles having a plurality of lengths simultaneously.

3. The apparatus of claim 1, further comprising retaining means to hold the plurality of bristles adjacent to the pins.

4. The apparatus of claim 3, wherein the pins are adapted and constructed to have a length such that an overlap between an end of the pin and an end of a bristle contacted by the pin is between 0.005 and 0.050 in. when the plurality of bristles is adjacent to the pins.

5. The apparatus of claim 1, wherein the pins are arranged on the base such that when the plate is in motion, each pin polishes ends of a pre-determined bundle of bristles.

6. The apparatus of claim 1, wherein the pins are constructed and arranged to polish a portion of a plurality of bristle bundles which vary in height such that all the bristle bundles could not be polished simultaneously with planar polishing means.

7. The apparatus of claim 1, wherein the pins are constructed and arranged to polish ends of bristles which are not oriented perpendicular to a plane of motion of the base.

8. The apparatus of claim 1, wherein the pins are constructed and arranged to only polish a portion of the plurality of bristles.

9. The apparatus of claim 1, wherein an end of each of the pins comprises a partially rounded tip having a radius of curvature between 0.075 and 0.08 inches.

10. The apparatus of claim 9, wherein the tip is a truncated hemisphere having a truncation depth between 2.5 and 65% of the radius of curvature.

11. The apparatus of claim 1, wherein the diameter of each pin is at least ⅛ inches.

12. The apparatus of claim 11, wherein the diameter of each pin is at least 5/32 inches.

13. The apparatus of claim 12, wherein the diameter of each pin is at least as long as a lateral dimension of a pattern defined by the plurality of bristles.

14. The apparatus of claim 1, wherein the abrasive coating comprises a diamond coating having a grit size between 200 and 600 grit.

15. A method of end-rounding bristles in a plurality of bundles, comprising:

selecting a two-dimensional motion path for a plate;

identifying a point on the plate that travels a path intercepting a position of a first bundle of bristles that is disposed in a polishing position with respect to the plate; and selecting an abrasive pin to place at the identified point having a height such that, when the first bristle bundle is disposed in the polishing position, the pin will polish ends of bristles in the first bristle bundle.

16. The method of claim 15, wherein the steps of identifying and selecting a pin are repeated for a subsequent point corresponding to a second bundle of bristles.

17. The method of claim 16, wherein the average height of the bristles in the first and second bundles of bristles are not the same.

18. The method of claim 15, wherein the pin is constructed and arranged to polish a portion of a plurality of bristle bundles which vary in height such that all the bristle bundles could not be polished simultaneously with planar polishing means.

19. The method of claim 15, wherein the pin is constructed and arranged to polish ends of bristles which are not oriented perpendicular to a plane of motion of the plate.

20. The method of claim 15, wherein the abrasive pin has a diameter and wherein the step of selecting further comprises selecting an abrasive pin having a height and diameter such that, when the first bristle bundle is disposed in a polishing position, the pin will polish ends of bristles in the first bristle bundle.

21. The method of claim 15, wherein an end of the pin comprises a partially rounded tip having a radius of curvature between 0.075 and 0.08 inches.

22. The method of claim 21, wherein the tip is a truncated hemisphere having a truncation depth between 2.5 and 65% of the radius of curvature, and wherein an abrasive is disposed on the tip.

23. The method of claim 15, wherein the diameter of the pin is at least 1/8 inch.

24. The method of claim 23, wherein the diameter of the pin is at least 5/32 inches.

25. The method of claim 16, wherein the diameter of the pin is at least as long as a lateral dimension defined by the greatest distance between a bristle in the first bristle bundle and a bristle in the second bristle bundle.

26. The method of claim 15, wherein the abrasive pin comprises a diamond coating having grit size between 200 and 600 grit.

27. A method of end-rounding a plurality of bristles, comprising:

disposing ends of the bristles in a path of a translatable abrasive pin; and moving the pin such that it polishes ends of the bristles.

28. The method of claim 27, wherein the bristles are disposed in at least one bundle of a plurality of bundles having a variety of heights such that all the bristle bundles could not be polished simultaneously with planar polishing means.

29. The method of claim 28, wherein the method is adapted for use with a plurality of bristle bundles.

30. The method of claim 27, wherein the path of the pin comprises a four-lobed pattern, wherein the four lobes define two perpendicular axes.

31. The method of claim 27, wherein the path of the pin comprises two superimposed four-lobed patterns, wherein each set of four lobes defines two perpendicular axes.

32. The method of claim 27, wherein the method is adapted for use with a plurality of pins.

33. The method of claim 27, wherein an end of the pin comprises a partially rounded tip having a radius of curvature between 0.075 and 0.8 inches.

34. The method of claim 33, wherein the tip is a truncated hemisphere having a truncation depth between 2.5 and 65% of the radius of curvature.

35. The method of claim 27, wherein the diameter of the pin is at least 1/8 inch.

36. The method of claim 35, wherein the diameter of the pin is at least 5/32 inches.

37. The method of claim 36, wherein the diameter of the pin is at least as long as a lateral dimension of a pattern defined by the plurality of bristles.

38. The method of claim 29, wherein the diameter of the pin is at least as long as a lateral dimension of a pattern defined by the plurality of bristle bundles.

39. The method of claim 27, wherein the abrasive pin comprises a diamond coating having a grit size between 200 and 600 grit.

* * * * *